United States Patent [19]

Woznick

[11] Patent Number: 4,972,639

[45] Date of Patent: Nov. 27, 1990

[54] SECURITY WINDOW

[76] Inventor: Kenneth R. Woznick, 27449 Pembroke, Livonia, Mich. 48152

[21] Appl. No.: 280,745

[22] Filed: Dec. 6, 1988

[51] Int. Cl.[5] ..... E06B 3/26

[52] U.S. Cl. ..... 52/202; 49/62

[58] Field of Search ..... 52/202, 203, 171; 49/62, 65, 66, 67, 50, 51, 52, 53, 54

[56] References Cited

U.S. PATENT DOCUMENTS

| | | | |
|---|---|---|---|
| 1,263,248 | 4/1918 | Hope | 49/62 |
| 1,934,546 | 11/1933 | Lewerentz | 49/62 |
| 2,877,840 | 3/1959 | Hurowitz | 49/67 |
| 2,895,184 | 7/1959 | O'Connor | 49/67 |
| 3,392,486 | 7/1968 | Luke | 49/62 |
| 3,978,614 | 9/1976 | Goldhaber | 52/202 |
| 4,663,885 | 5/1987 | Stibolt | 49/67 |
| 4,685,261 | 8/1987 | Seaquist | 52/202 |

*Primary Examiner*—John E. Murtagh

*Attorney, Agent, or Firm*—Brooks & Kushman

[57] ABSTRACT

A covering device (10) of the type used to protect a window (12) from breakage and provide security is disclosed as including a barrier structure (28) including a barrier frame (30). The barrier structure (28) includes a plurality of reinforcing members (36) which are sandwiched between spaced apart inside and outside barrier panes (38). Barrier frame (30) includes an outwardly extending peripheral flange (32) which abuts with an inwardly extending peripheral flange (22) of a window frame (14) that mounts a window sash (16).

2 Claims, 3 Drawing Sheets

SECURITY WINDOW

TECHNICAL FIELD

This invention relates to a covering device for a window and more particularly to a protective cover for a basement window.

BACKGROUND ART

Uninvited access into a residence is often gained through a basement window. Although these entries are not confined to basement windows, a basement window opening is usually extremely vulnerable.

Steps taken to discourage and prohibit these entries include boarding up or bricking up the basement window opening or fixing protective bars across the window opening. All of these steps have advantages and disadvantages but one disadvantage that they all include is the inability to exit from a basement window once the protective step have been taken. The ability to exit through a basement window is extremely important in the event of a fire that barricades the normal means of exit.

When a basement window is boarded up or bricked up, not only is access through the opening eliminated but the transmission of natural light through the opening is usually eliminated. Glass blocks have been used to preserve the transmission of natural light but any access way is eliminated.

The following is a list of U.S. Patents revealed in a search conducted on the herein disclosed invention.

U.S. Pat. No. 1,999,504 discloses a window covering device including a sheet of metal having upper and lower edges inwardly turned to form grooves to receive a peripheral flange of a window sash. The covering is adapted to be slipped over the window sash such that the peripheral flange at upper and lower edges of the sash will be received in the grooves formed as upper and lower edges of the sheet metal.

U.S. Pat. No. 2,170,110 discloses a supplemental protective closure for covering windows. The closure includes overbent retaining portions adapted to overengage flanges on a metallic framed window for securing the cover on the window.

U.S. Pat. No. 2,384,929 discloses a casement storm window which is sectional and in which certain parts of the window are independently mounted on stationary parts of a casement window and other parts are mounted on a movable part of the casement window.

U.S. Pat. No. 2,631,698 discloses a storm shutter for use with a casement type window. The storm shutter has a flange frame corresponding to the outer dimension of the casement sash, and the shutter flange is adapted to engage over the flange of the sash and be secured on the sash by nuts and bolts.

U.S. Pat. No. 3,392,486 discloses a storm shutter for awning type windows that includes elongated clips having U-shaped cross section for securing a protective covering on a window.

U.S. Pat. No. 4,389,816 discloses a sheet metal protective covering for awning windows. The protective covering includes a grooved flange along one edge and an extension extending perpendicular to the cover at the opposite edge for fastening the protective cover on an awning window.

DISCLOSURE OF INVENTION

An object of the present invention is to provide an improved covering device for a window that provides security against intrusion and vandalism, is inexpensive, is easy to install, and is quickly removable and also provides energy savings.

In carrying out the above object, and other objects of the invention, the covering device is used in combination with a window embodying a window frame and a window sash. The window sash is connected to the frame in such a manner that the sash may be moved between inwardly opened and closed positions. The window frame has an inwardly extending peripheral flange along its outsidely facing edges. The inside perimeter of the flange forms an opening in a wall in which the window is mounted. The frame envelopes the window sash in the closed position of the window and the sash also abuts the flange in the closed position.

The covering device for the opening comprises a barrier structure that includes a barrier frame of a generally complementary shape as the opening. The barrier frame mounts the barrier structure and is positionable in the opening to close the opening. The barrier frame includes an outwardly extending peripheral flange along inside edges of the barrier frame. The outwardly extending flange abuts with the inwardly extending flange in a mounted position of the barrier structure to provide additional security against intrusion through the window.

In the preferred embodiment of the invention, the barrier structure is retained in the window frame as the outwardly extending flange is clamped between the inwardly extending flange and the window sash in the closed position of the window. The barrier structure is a high impact resistant material such as a fiberglass sheet. Most preferably, the barrier structure is FILONE fiberglass material.

In such a preferred embodiment of the invention, the barrier frame is made of metal. The barrier frame includes a plurality of reinforcing members extending between opposing barrier frame segments for additional strength and reinforcement of the barrier structure. In its preferred embodiment, the barrier structure comprises spaced apart inside and outside barrier panes sandwiching the reinforcing members therebetween and forming an energy saving sealed inner compartment.

The objects, features, and advantages of the present invention are readily apparent from the following detailed description of the best mode for carrying out the invention when taken with the accompanying drawings.

Figure 3:
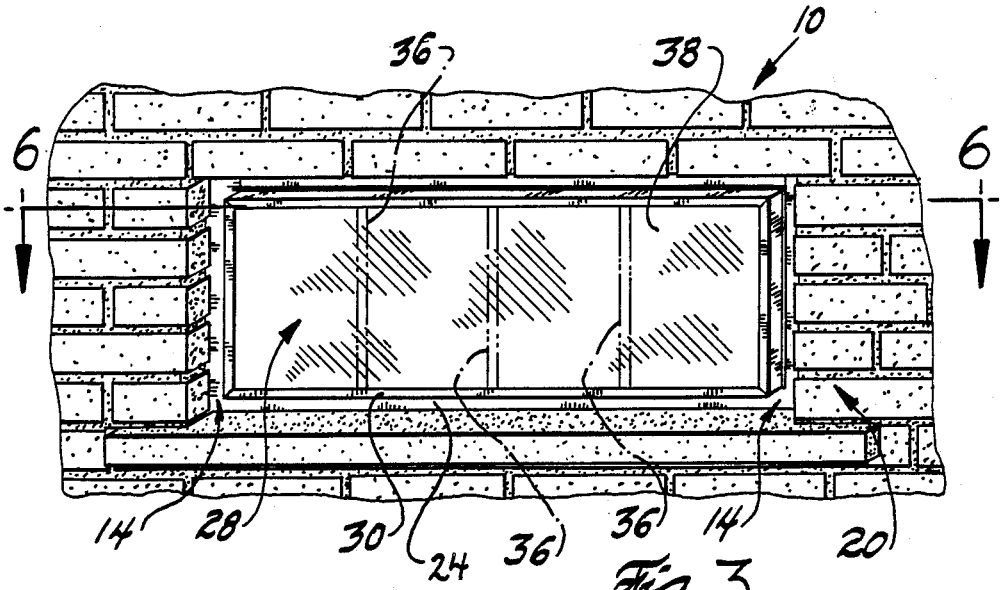
FIG. 3 is an elevational view of the covering device mounted in the conventional window frame in the basement wall.
Figure 5:
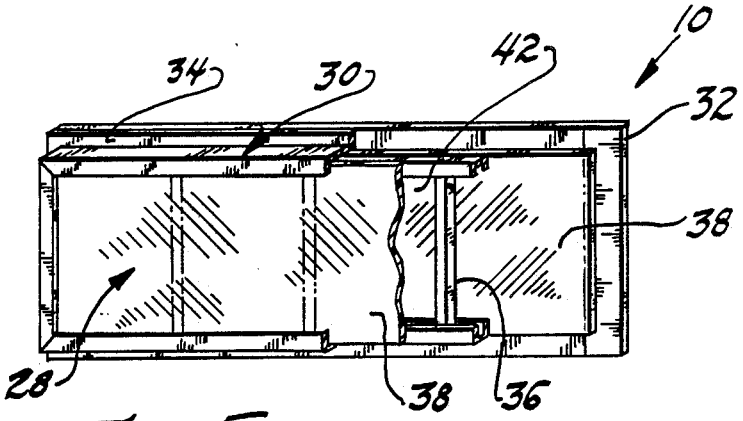
Figure 6:
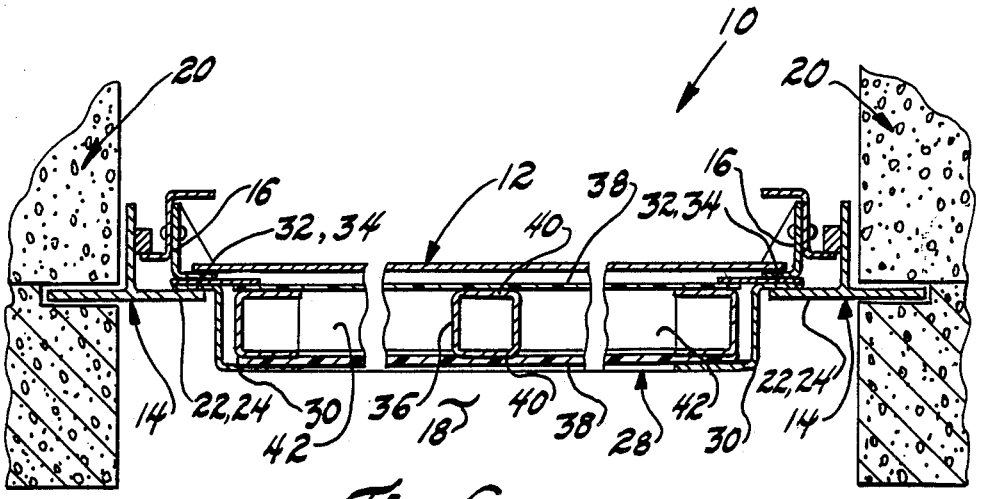
Figure 7:
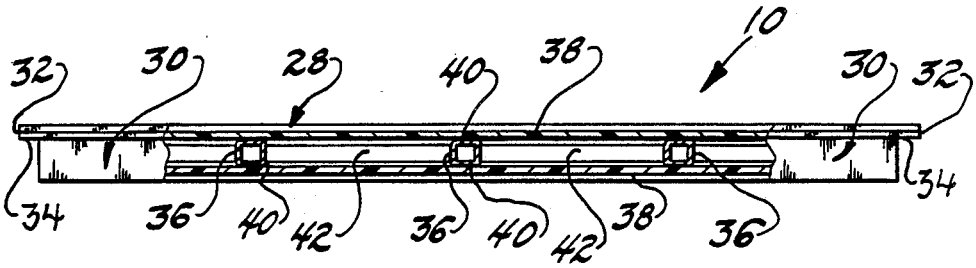

3 illustrating its retention between the conventional window and window frame;

FIG. 5 is a broken-out view of a covering device illustrating its construction;

FIG. 6 is a cross-sectional view taken along line 6—6 in FIG. 3 illustrating the mounting of the covering device; and FIG. 7 is a partial sectional plan view of the covering device covering spaced-opposed panes forming a barrier structure that sandwiches reinforcing bars therebetween and form sealed air spaced therein.

BEST MODE FOR CARRYING OUT THE INVENTION

Figure 1:
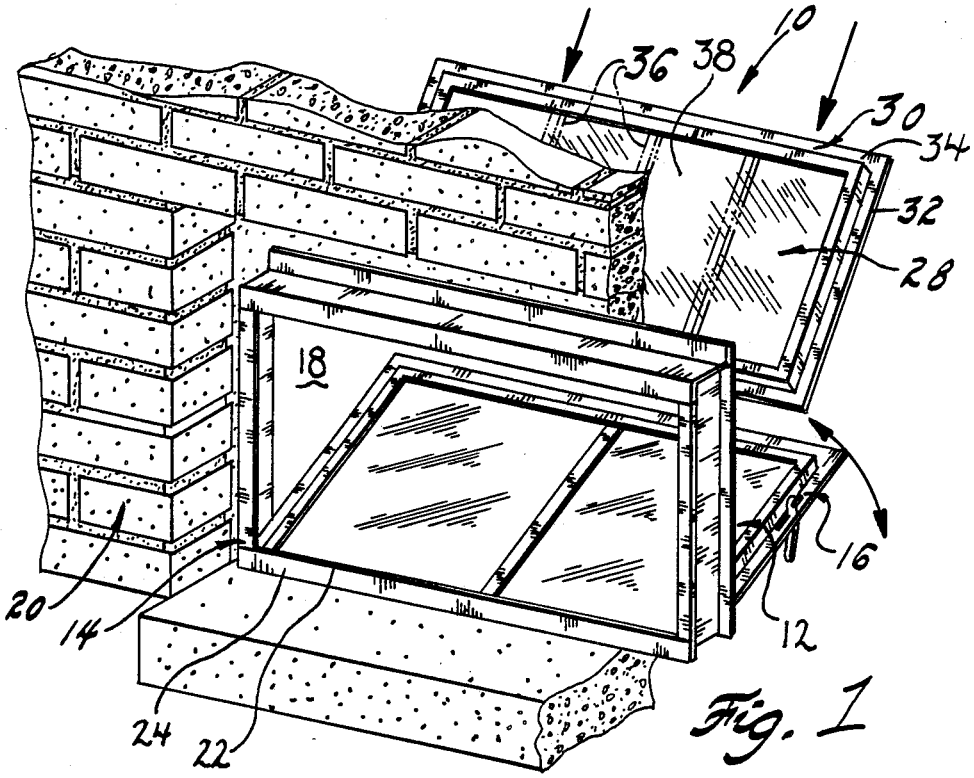
FIG. 1 is an environmental perspective view of a conventional basement window and frame in a basement wall illustrating the mounting of a covering device constructed in accordance with the present invention in between the window and frame.

With reference to FIG. 1 of the drawings, a covering device, for a window, constructed in accordance with the present invention is generally indicated by 10. Covering device 10 is used to provide security against uninvited entry into a basement through a window opening, is inexpensive and easy to install. As is hereinafter more fully described, the covering device 10 is quickly removable if necessary as in the case of fire and it also provides energy savings by increasing the R-value at the window opening.

Figure 2:
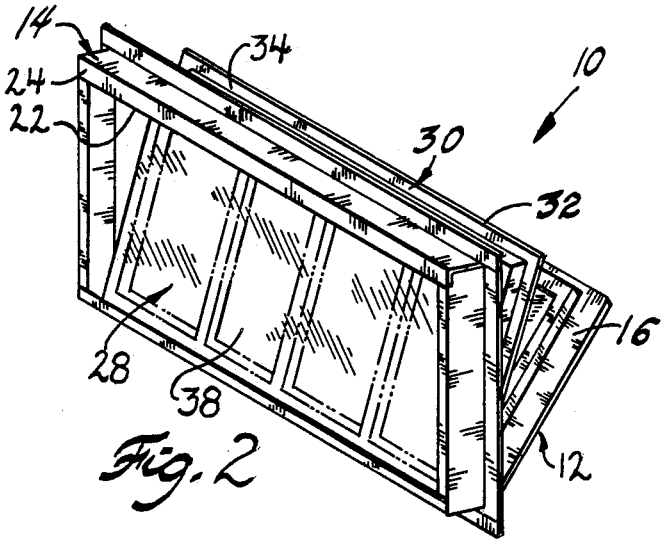
FIG. 2 is a detailed perspective view of the mounting of the covering device illustrating the closing of the window to mount the covering device.

As shown in FIGS. 1 through 3 of the drawings, the covering device 10 is used in combination with a conventional basement window 12 embodying a metallic window frame 14 and a metallic window sash 16 hingedly connected to the frame by any suitable means. The frame 14 is mounted in an opening 18 in a basement wall 20. In such a window arrangement, the sash 16 may be swung between inwardly opened, FIG. 1, and closed, FIG. 3, positions to open and close the opening 18. With reference to FIGS. 4 through 7, the window frame 14 has an inwardly extending peripheral flange 22 along its outsidely facing edges 24 as shown in FIGS. 1 and 2. The flanged inside perimeter of the metallic window frame 14 forms an opening which is the window opening. The frame 14 envelopes the window sash 16 in the closed position of the window 12 to form a generally loose fit of the window in the frame. The sash 16 also abuts the flange 22 in the closed position of the window 12.

Figure 4:
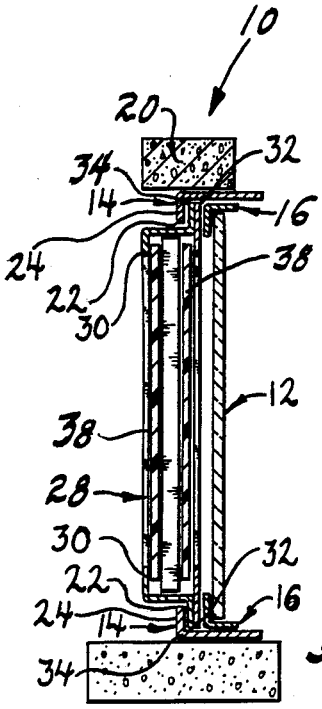
FIG. 4 is a sectional, side-elevational view of the mounted covering device taken along lines 4—4 in FIG.

With reference to FIG. 5 of the drawings, the covering device 10 includes a barrier structure 28 including a barrier frame 30 of a generally complementary shape as the window opening in the metallic window frame 14. The barrier frame 30 mounts the barrier structure 28 in the metallic window frame 14 and is positionable in the window opening adjacent the basement window 12 thereby closing the opening as shown in FIGS. 3 and 4. The barrier frame 30 includes an outwardly extending peripheral flange 32, best seen in FIGS. 1, 2, 4, 5 and 7 along the inside edges 34 of the barrier frame. The outwardly extending flange 32 of the barrier frame 30 abuts with the inwardly extending flange 22 of the window frame 14 in a mounted position of the barrier structure 28. The mounted barrier structure 28 provides additional security against intrusion through the basement window 12.

With reference to FIGS. 1, 2, 4 and 6 of the drawings, the barrier structure 30 is retained in the window frame 14 as the outwardly extending flange 32 of the covering device 10 is clamped between the inwardly extending flange 22 on the window frame 14 and the window sash 16 in the closed position of the window 12. The covering device 10 is easily removable by opening the window 12 and removing the covering device from the window frame 14 if the need arises.

Preferably, the barrier structure 28 is of a high impact resistant material such as a fiberglass sheet which will resist intrusive impacts on the barrier structure surface. Most preferably, the barrier structure 28 is FILONE fiberglass material.

In the preferred construction, the barrier frame 30 is made of a metal material such as steel which provides high strength at relatively low cost and is easy to assemble. As shown in drawing FIGS. 1, 2, 3, 5, 6 and 7, the barrier frame 30 includes a plurality of reinforcing members 36 which extend between opposing barrier frame segments. Preferably, these reinforcing members are also of a metal construction such as steel although other materials are contemplated. These reinforcing members 36 provide additional strength and reinforcement of the barrier structure 28 and make it much more difficult to gain access through the basement window 12 even if the barrier structure is compromised.

With further reference to drawing FIGS. 6 and 7, the preferred barrier structure 28 comprises spaced apart inside and outside barrier panes 38, of the preferred fiberglass materials, which sandwich the reinforcing members 36 therebetween. A sealer 40 is used to secure the panes 38 to the reinforcing members 36. This structural arrangement forms energy saving sealed inner compartments 42. This arrangement provides an extra layer of fiberglass through which any projectile or striking means would have to travel before the window 16 would be contacted and as an added feature the inner compartments increase the R-value through the window opening resulting in energy savings if the basement is heated or cooled.

With reference to FIGS. 1, 2, and 4 of the drawings, it can be readily appreciated that covering device 10 is easily mountable into the conventional basement window frame 14 without making any structural alterations to the window frame or window 12. As shown in FIG. 1, covering device 10, referred to as barrier structure 28, is placed in between window frame 14 and window 12 when the window is in its open position. Then, as illustrated in FIG. 2, window 12 is brought toward a closed position of the window whereby barrier member 28 becomes sandwiched between the window and frame 14. Finally, FIG. 4 illustrates the closed position of window 12 wherein the barrier member 28 is mounted between the window 12 and frame 14 with the peripheral flange 32 of the barrier member abutting the inwardly extending flange 22 of the window frame 14.

While the best mode for carrying out the invention has been described in detail, those familiar with the art to which this invention relates will recognize alternative ways for practicing the invention as defined by the following claims.

What is claimed is:

1. In combination with a window embodying a window frame and a window sash connected to said frame in such a manner that the sash may be moved between open and closed positions, the window frame having an inwardly extending peripheral flange along its outsidely facing edges; the flange's inside perimeter forming an opening; said frame enveloping the window sash therein the closed position; a covering device for said opening, said covering device comprising: a barrier structure including a metallic barrier frame of a generally complementary shape as said opening; said barrier frame including opposing frame segments and having reinforcing members extending between opposing frame segments; said barrier frame mounting said barrier structure and being positionable in the opening thereby closing the opening; said barrier frame including an outwardly extending peripheral flange along inside edges of said barrier frame; said outwardly extending flange abutting with said inwardly extending flange in a mounted position of said barrier structure thereby providing additional security against intrusion through said window; and said barrier structure also including spaced apart inside and outside barrier panes sandwiching said reinforcing members therebetween and forming an energy-saving sealed inner compartment.

2. For use solely in combination with a window embodying a window frame and a window sash hinged to said frame for movement between open and closed positions, the window frame having an inwardly extending peripheral flange forming an opening which envelopes the window sash when the sash is in its closed position; a unitary barrier structure insertable into said opening independently of said sash when said sash is in its open position, said barrier structure including a barrier frame complementary to said opening for closing the opening when inserted therein; said barrier frame including an outwardly extending peripheral flange abutting the inwardly extending flange of said window frame when inserted into said opening and sandwiched between the flange of said window frame and said sash when said sash is in its closed position to retain said barrier structure in said opening, said barrier frame including a reinforcing member extending between opposing barrier frame segments for additional strength and reinforcement of said barrier structure, and said barrier structure further including spaced apart inside and outside barrier panes sandwiching said reinforcing member therebetween and forming an energy-saving sealed inner compartment.

* * * * *